US008047876B1

(12) United States Patent
Liao et al.

(10) Patent No.: US 8,047,876 B1
(45) Date of Patent: Nov. 1, 2011

(54) ELECTRICAL CONNECTOR

(75) Inventors: Wei-Hong Liao, Tu-Cheng (TW); Ming-Chiang Chen, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/843,876

(22) Filed: Jul. 26, 2010

(51) Int. Cl.
*H01R 24/00* (2011.01)

(52) U.S. Cl. ..... 439/660; 439/733.1

(58) Field of Classification Search ..... 439/660, 439/733.1, 499, 874
See application file for complete search history.

(56) References Cited

U.S. PATENT DOCUMENTS 3,757,277 A * 9/1973 Yamanoue et al. ..... 439/660
4,045,114 A * 8/1977 Dechelette ..... 439/634
4,715,820 A * 12/1987 Andrews et al. ..... 439/59
5,254,010 A * 10/1993 Davis ..... 439/108
6,364,702 B1 * 4/2002 Mochizuki et al. ..... 439/579
6,755,693 B2 * 6/2004 Nishio et al. ..... 439/660

* cited by examiner

*Primary Examiner* — Phuong Dinh
(74) *Attorney, Agent, or Firm* — Cheng-Ju Chiang

(57) ABSTRACT

An electrical connector includes an insulating body which has base boards aligned at intervals along a transverse direction, propping portions each connected between adjacent two base boards to divide an interval between the adjacent two base boards into two parts designated as a receiving cavity and a receiving passage, and a connecting body traversed on rear ends of top edges of the base boards, and terminals each having a connecting strip, a soldering slice and an elastic arm oppositely extending from two ends of the connecting strip. The connecting strip and the soldering slice are disposed in the receiving passage with the soldering slice abutting against a bottom of the connecting body, the connecting strip propped up by the propping portion, and two opposite side edges of the connecting strip and the soldering slice abutting against insides of the receiving passage. The elastic arm stretches into the receiving cavity.

3 Claims, 5 Drawing Sheets

ELECTRICAL CONNECTOR

BACKGROUND OF THE INVENTION

1. Field of the Invention

The present invention relates to an electrical connector, and more particularly to an electrical connector capable of stopping solder flowing forwards to damage a contact portion of a terminal thereof.

2. The Related Art

Referring to FIG. 5 and FIG. 6, a traditional electrical connector 2 includes an insulating body 30 and a plurality of terminals 35. The insulating body 30 has a base portion 33 and a tongue portion 31 extending forward from a middle of the base portion 33. The base portion 33 defines a plurality of fastening passages 34 arranged at regular intervals along a transverse direction thereof and each extending longitudinally to penetrate through the base portion 33. A top of the tongue portion 31 defines a plurality of receiving cavities 32 corresponding to the fastening passages 34 respectively and each extending longitudinally to be connected with a bottom of a front end of the corresponding fastening passage 34. The terminal 35 has a fastening slice 351, a soldering tail 352 and a contact portion 353 connected with two opposite ends of the fastening slice 351. The fastening slice 351 is fastened in the respective fastening passage 34, the contact portion 353 projects upward out of the corresponding receiving cavity 32, and the soldering tail 352 stretches rearward beyond the base portion 33 for being soldered with an external cable (not shown).

However, the fastening passage 34 is connected with the corresponding receiving cavity 32 without any preventing structures therebetween. As a result, when the soldering tail 352 is soldered with the cable, the solder is apt to flow into the receiving cavity 32 along the fastening passage 34 to damage the contact portion 353. In order to prevent the solder from flowing into the receiving cavity 32, the connector 2 further includes a rear lid 36 mounted behind the base portion 33 to seal up the fastening passages 34. The soldering tail 352 further passes through the rear lid 36 and then is soldered with the cable. However, it need take extra manpower and material resources to manufacture the rear lid 36 so that results in the increase of manufacture cost of the connector 2.

SUMMARY OF THE INVENTION

It is an object of the present invention to provide an electrical connector which includes an insulating body and a plurality of terminals. The insulating body has a plurality of base boards aligned at intervals along a transverse direction. A propping portion is connected between each adjacent two of the base boards to divide an interval between the adjacent two base boards into two parts respectively designated as a receiving cavity in front of the propping portion and a receiving passage behind the propping portion. The insulating body further has a connecting body traversed on rear ends of top edges of the base boards and apart from the propping portions. Each of the terminals has a connecting strip, a soldering slice and an elastic arm oppositely extending from two opposite ends of the connecting strip. A free end of the elastic arm is arched upward to form a contact portion. The connecting strip and the soldering slice are disposed in the receiving passage, the elastic arm stretches into the receiving cavity through a top of the propping portion, and the contact portion projects upward out of the receiving cavity. Wherein the soldering slice abuts against a bottom of the connecting body, a front end of the connecting strip is propped up by the top of the propping portion, and two opposite side edges of the connecting strip and the soldering slice abut against two opposite insides of the receiving passage, so that can stop solder from flowing into the receiving cavity along the receiving passage, when the soldering slice is soldered with an external cable.

As described above, the electrical connector of the present invention can effectively stop the solder flowing into the receiving cavity along the receiving passage, by means of the soldering slice abutting against the bottom of the connecting body, the connecting strip being propped up by the top of the propping portion, and the two opposite side edges of the connecting strip and the soldering slice abutting against the insides of the receiving passage so as to absolutely separate the receiving passage from the receiving cavity. So the electrical connector of the present invention can effectively economize manpower and material resources and further reduce manufacture cost thereof.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
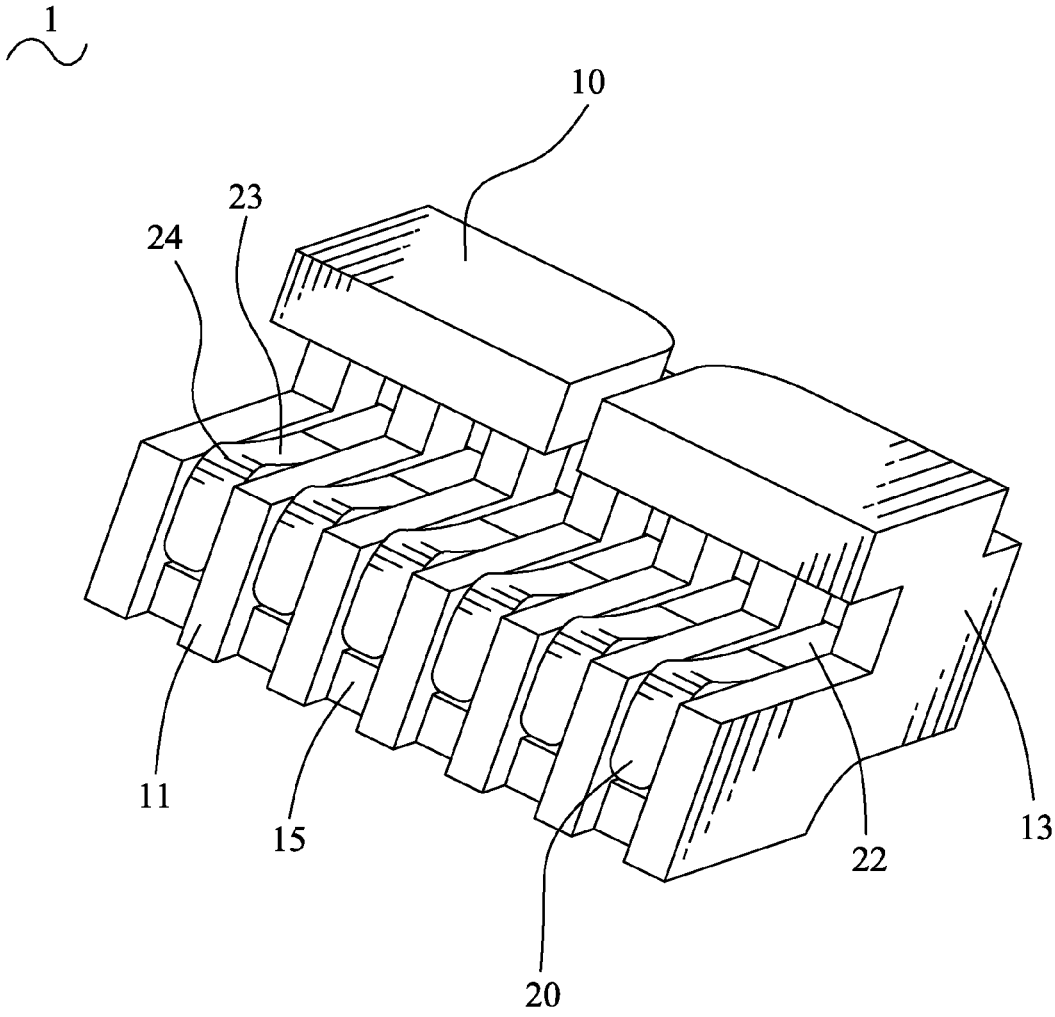
FIG. 1 is a perspective view of an electrical connector in accordance with the present invention.
Figure 2:
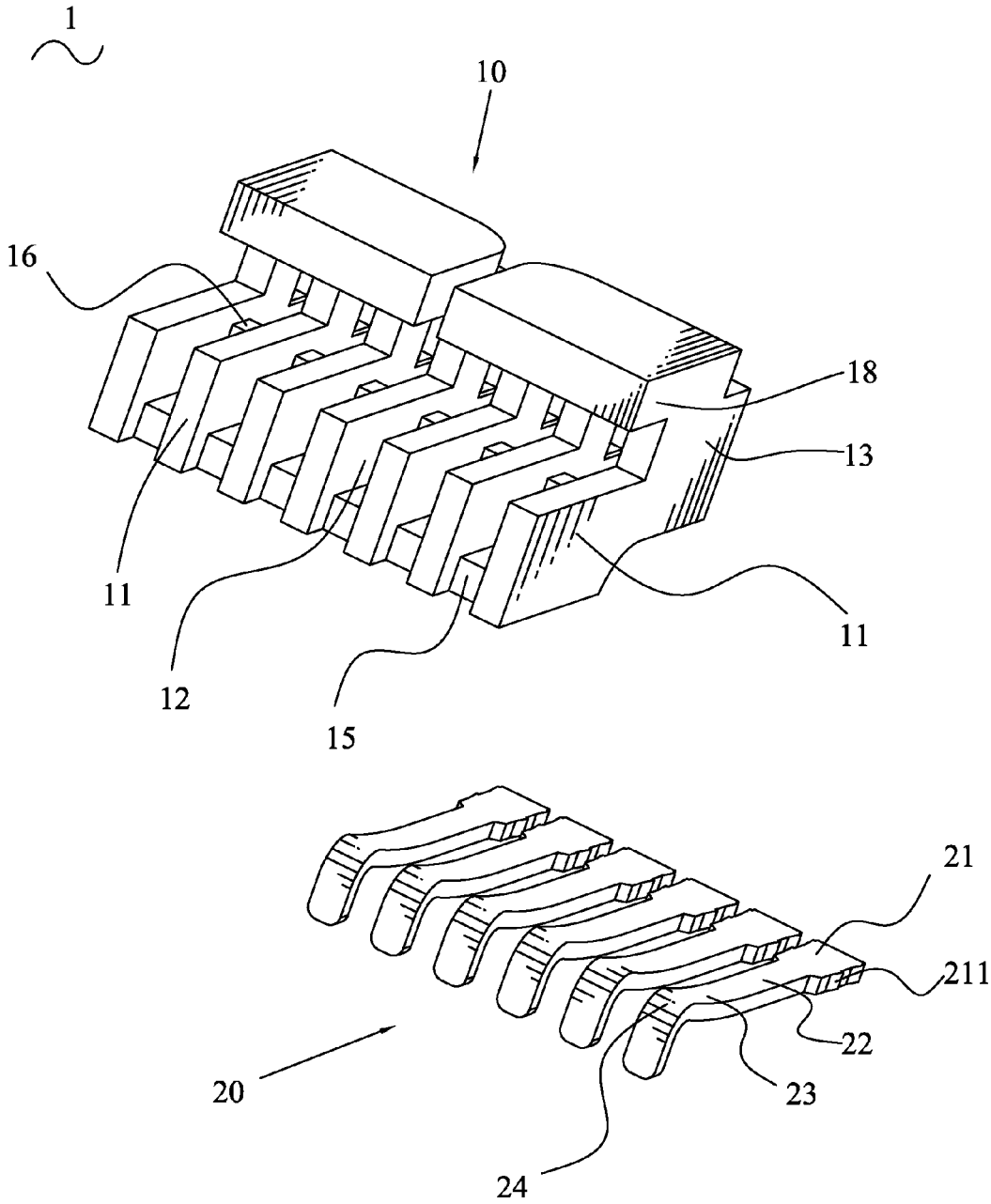
FIG. 2 is an exploded perspective view of the electrical connector of FIG. 1.

Referring to FIG. 1 and FIG. 2, an electrical connector 1 according to the present invention includes an insulating body 10 and a plurality of terminals 20 disposed in the insulating body 10 respectively.

Figure 3:
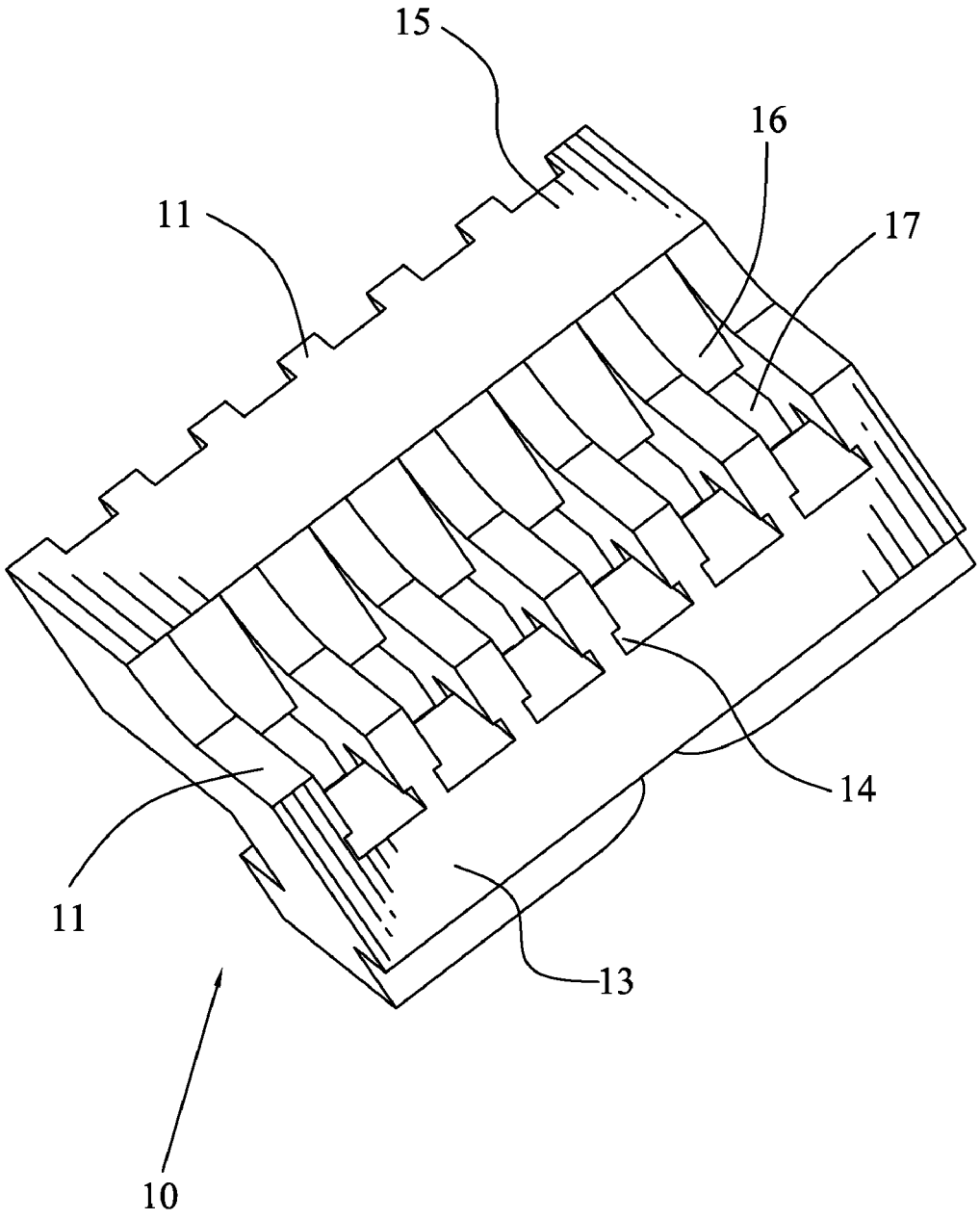
FIG. 3 is a perspective view of an insulating body of the electrical connector of FIG. 1.
Figure 4:
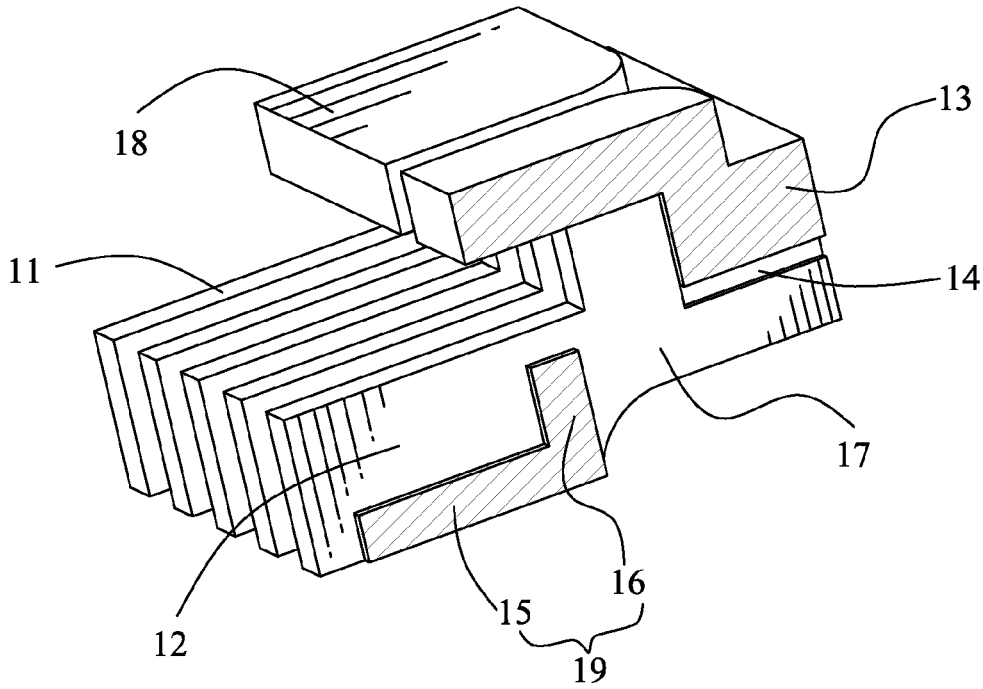
FIG. 4 is a cutaway perspective view of the insulating body of the electrical connector of FIG. 1.
Figure 5:
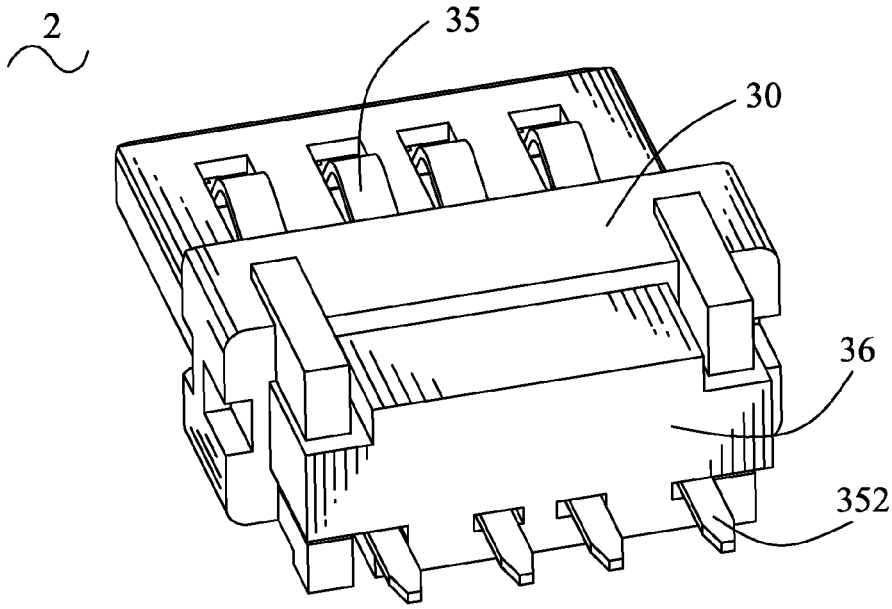
FIG. 5 (Prior Art)
FIG. 5 is a perspective view of an electrical connector of the prior art.
Figure 6:
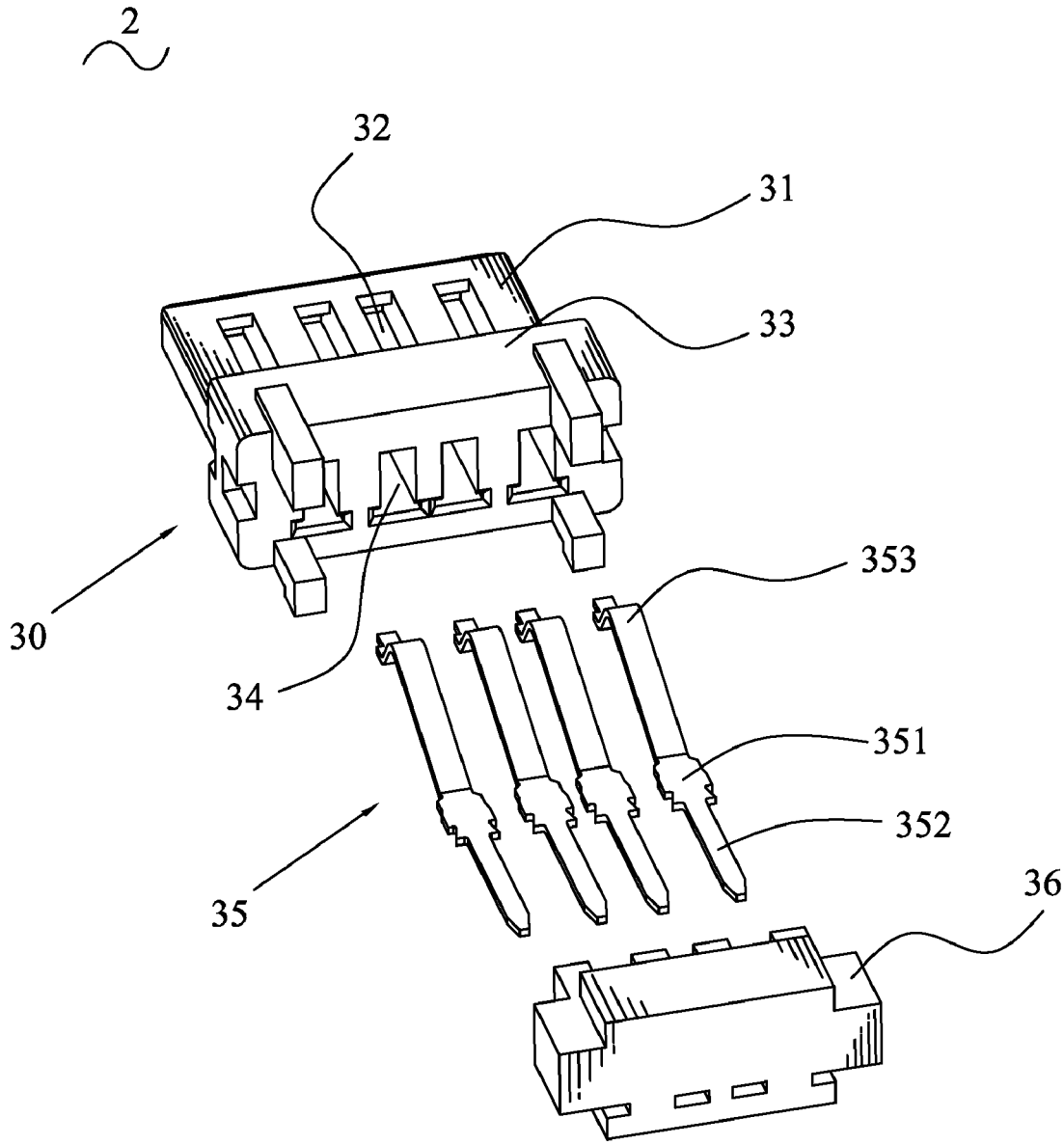
FIG. 6 (Prior Art)
FIG. 6 is an exploded perspective view of the electrical connector of FIG. 5.

Referring to FIG. 2, FIG. 3 and FIG. 4, the insulating body 10 has a plurality of substantially rectangular base boards 11 aligned at regular intervals along a transverse direction, with each two adjacent of the base boards 11 parallel and facing to each other. An L-shaped propping member 19 is connected between fronts of the adjacent two base boards 11. The propping member 19 has a connecting portion 15 extending longitudinally, and a propping portion 16 protruding upward from a rear end of the connecting portion 15. The propping portion 16 divides the interval between the adjacent two base boards 11 into two parts, respectively designated as a receiving cavity 12 in front of the propping portion 16 and a receiving passage 17 behind the propping portion 16. The receiving passage 17 is connected with the receiving cavity 12 to span a top of the propping portion 16. The insulating body 10 further has a long rectangular connecting body 13 traversed on rear ends of top edges of the base boards 11 and apart from the propping portions 16. A rear end of a top of each receiving passage 17 further extends toward two opposite sides to form a pair of fastening grooves 14 adjacent to a bottom of the connecting body 13. A top of the connecting body 13 protrudes forward to form two preventing portions 18.

Each of the terminals 20 has a connecting strip 22, a soldering slice 21 and an elastic arm 23 oppositely extending from two opposite ends of the connecting strip 22. The elastic arm 23 is further inclined upward beyond a plane of the connecting strip 22. A free end of the elastic arm 23 is arched upward to form a contact portion 24. Two opposite side edges of the soldering slice 21 oppositely protrude outward to form a pair of fastening portions 211.

Referring to FIGS. 1-4 again, when the terminals 20 are assembled to the insulating body 10, the connecting strip 22 and the soldering slice 21 are disposed in the receiving passage 17 with the soldering slice 21 abutting against the bottom of the connecting body 13, a front end of the connecting strip 22 being propped up by the top of the propping portion 16 and two opposite side edges of the connecting strip 22 abutting against two opposite insides of the receiving passage 17, so that makes the receiving passage 17 absolutely separated from the receiving cavity 12 so as to prevent solder from flowing into the receiving cavity 12 along the receiving passage 17, when the soldering slice 21 is soldered with an external cable (not shown). The fastening portions 211 are fastened in the corresponding fastening grooves 14 to secure the soldering slice 21 in the receiving passage 17. The elastic arm 23 stretches forward into the respective receiving cavity 12 through the top of the propping portion 16, and the contact portion 24 projects upward out of the receiving cavity 12.

As described above, the electrical connector 1 of the present invention can effectively stop solder flowing into the receiving cavity 12 along the receiving passage 17, by means of the soldering slice 21 abutting against the bottom of the connecting body 13, the connecting strip 22 being propped up by the top of the propping portion 16 and the two opposite side edges of the connecting strip 22 abutting against the insides of the receiving passage 17 so as to absolutely separate the receiving passage 17 from the receiving cavity 12. So the electrical connector 1 of the present invention can effectively economize manpower and material resources and further reduce manufacture cost thereof.

What is claimed is:

1. An electrical connector, comprising:

an insulating body having a plurality of base boards aligned at intervals along a transverse direction, a propping portion being connected between each adjacent two of the base boards to divide an interval between the adjacent two base boards into two parts respectively designated as a receiving cavity in front of the propping portion and a receiving passage behind the propping portion, the insulating body further having a connecting body traversed on rear ends of top edges of the base boards and apart from the propping portions; and a plurality of terminals each having a connecting strip, a soldering slice and an elastic arm oppositely extending from two opposite ends of the connecting strip, a free end of the elastic arm being arched upward to form a contact portion, the connecting strip and the soldering slice being disposed in the receiving passage, the elastic arm stretching into the receiving cavity through a top of the propping portion, and the contact portion projecting upward out of the receiving cavity, wherein the soldering slice abuts against a bottom of the connecting body, a front end of the connecting strip is propped up by the top of the propping portion, and two opposite side edges of the connecting strip and the soldering slice abut against two opposite insides of the receiving passage, so that can stop solder from flowing into the receiving cavity along the receiving passage, when the soldering slice is soldered with an external cable.

2. The electrical connector as claimed in claim 1, wherein a longitudinal connecting portion is connected between fronts of the adjacent two base boards, a rear end of the connecting portion is connected with a bottom of the propping portion.

3. The electrical connector as claimed in claim 1, wherein a rear end of a top of the receiving passage further extends toward two opposite sides to form a pair of fastening grooves adjacent to the bottom of the connecting body, the two opposite side edges of the soldering slice oppositely protrude outward to form a pair of fastening portions fastened in the corresponding fastening grooves.

* * * * *